United States Patent [19]

Liepert

[11] Patent Number: 5,076,565

[45] Date of Patent: Dec. 31, 1991

[54] SHEET FEEDER

[75] Inventor: Rudolf Liepert, Augsburg, Fed. Rep. of Germany

[73] Assignee: Georg Spiess GmbH, Gersthofen, Fed. Rep. of Germany

[21] Appl. No.: 654,215

[22] Filed: Feb. 12, 1991

[30] Foreign Application Priority Data

Feb. 17, 1990 [DE] Fed. Rep. of Germany ..... 4005144

[51] Int. Cl.[5] ..... B65H 5/08

[52] U.S. Cl. ..... 271/14; 271/93; 271/107; 271/108

[58] Field of Search ..... 271/8.1, 18, 90–93, 271/11, 14, 105–108

[56] References Cited

U.S. PATENT DOCUMENTS

| | | | |
|---|---|---|---|
| 2,338,050 | 12/1943 | Nelson et al. | 271/14 |
| 3,724,687 | 4/1973 | Marshke et al. | 271/90 |
| 4,002,332 | 1/1977 | Hoenigmann | 271/103 |
| 4,516,762 | 5/1985 | Moltrasio et al. | 271/11 |
| 4,786,043 | 11/1988 | Jiruse et al. | 271/103 |

*Primary Examiner*—H. Grant Skaggs
*Attorney, Agent, or Firm*—Edwin D. Schindler

[57] ABSTRACT

In the context of a sheet feeder comprising a suction head, which is provided with separating suckers arranged on a vertically movable support, and at least one row of drag suckers mounted on a support, which is adapted to be reciprocated partly at the same rate as conveyor means for further transport and is preferably able to be pivot for righting oblique sheets, such drag suckers being adapted to be supplied with vacuum on the transfer of a sheet from the separating suckers and to be vented on the release of the sheet to such means for further conveyance thereof, it is possible to ensure a more rapid decrease in the vacuum level on sheet transfer if the drag sucker support, which is able to be reciprocated and is provided with at least one venting opening and a closing member associated with it, such closing member is able to be lifted from its seat within the constant rate range of the drag suckers and the further conveyor means, by means of a control member secured to the suction head.

23 Claims, 2 Drawing Sheets

SHEET FEEDER

BACKGROUND OF THE INVENTION

The invention relates to a sheet feeder comprising a suction head, which is provided with separating suckers arranged on a vertically movable support, and at least one row of drag suckers mounted on a support, which is adapted to be reciprocated partly at the same speed as conveyor means for further transport and is preferably able to be pivoted for righting oblique sheets, such drag suckers being adapted to be supplied with vacuum on the transfer of a sheet and to be vented on the release of the sheet from the separating suckers to such means for further conveyance thereof.

In known arrangements of this type the venting of the drag suckers is performed via a central suction air control valve arranged in the suction head and which is controlled by means of a separate drive cam. However adjacent to this suction air control valve there are normally only comparatively small cross sections for venting. Furthermore owing to the large distance between the suction air control valve and the drag suckers there is a large dead space contained in the ducts, which has to be vented. Therefore in the case of the conventional arrangements there is a only a sluggish venting action and drop in the level of the vacuum, more particularly since the degree of vacuum is comparatively low. These features mean that in the case of transfer at the same speed it is necessary to allow a long period in which the drag suckers and the timing roll accepting the sheet from them move at the same speed in accordance with the time of transfer of the products at all speeds and this means that the drag suckers have to be smartly accelerated and slowed down. This in turn means that, more particularly when the machine is running fast, there will be sudden loading and jerky movement of the mechanism leading to rough and irregular performance likely to involve failure.

Although it is conceivable that the venting of the drag suckers might be timed to start ahead of sheet transfer, this would involve a modification of the timing cam for the suction air valve. Furthermore such a change in the cam would make operation dependent on the speed of the machine owing to the use of a single turn shaft to drive the cam. It would seem that this is the reason that so far this modified design has not been accepted and the disadvantages of the prior art are tolerated.

SHORT SUMMARY OF THE PRESENT INVENTION

Accordingly one object of the invention is to so improve a sheet feeder of the type initially mentioned using simple and low-price means that a comparatively rapid drop in the vacuum level becomes possible.

This aim is to be achieved in accordance with the invention since the drag sucker support, which is able to be reciprocated, is provided with at least one venting opening and a closing member associated with it, such closing member being able to be lifted from its seat within the equal speed range of the drag suckers and the further conveyor means, by means of a control member secured to the suction head.

The features lead to a venting device with the advantage that it is actuated by means of the reciprocating drag sucker support and this leads to a simple structure and reliable operation. Furthermore it is possible to ensure that the point in time at which the drag suckers release the sheet is at a predetermined instant in the machine cycle independent of the speed of the machine. For this practically any point in the machine cycle may be used which is in the desired range, that is to say in the equal speed range in which the drag suckers and the parts responsible for further conveyance of the sheet products are moving at the same speed. It is convenient if the transfer is performed towards the end of the equal speed range, which in this case, owing to venting of the drag suckers near the same, may extend as far as the front end position of the drag sucker support. It is an advantage in this connection as well that simple adjustment of the timing of venting is possible by modification of the position of the control member arranged on the suction head. For this purpose the control member may be arranged in an adjustable manner. Since the venting opening or openings are provided adjacent to the drag sucker support, there is the advantage of a very small duct capacity which has to be vented. Furthermore adjacent to the drag sucker support it is possible to have comparatively large venting cross sections. The features in accordance with the invention thus lead to the advantage of such a rapid drop in the level of vacuum that for this purpose practically the point in time of the sheet transfer to the timing rolls is sufficient. The venting of the drag suckers thus only has to take place directly adjacent to the front end position of the drag sucker support or right at the same position. The sheets may accordingly be doubly guided for a comparatively long time on transfer, this leads to particularly high precision. Owing to the short idle time there is however the possibility of having a very short equal speed range. Therefore it is possible to smoothly speed up the drag suckers to the equal speed, that is to say to the speed of the part responsible for the further conveying action, for instance in the form of a timing roll, and, respectively, to slow the same down to standstill. This leads to the advantage of gentle running conducive to a good working life and generally to a freedom from failures. The features in accordance with the invention accordingly furthermore make possible an increase in the speeds of the machine. In conjunction with this there is furthermore the advantage that the sheets, as noted, are released independently of the speed at a predetermined point in the machine cycle.

It is convenient if the venting opening with the associated closing member and/or the control member are designed in such a manner that the control takes effect independent of the angular position of the drag sucker support in order to operate the closing member. This ensures that the drag sucker support may be pivoted in order to right a so-called oblique sheet setting, by means of which a skew sheet may be aligned correctly without this having any effect on the venting of the drag suckers.

In accordance with a further possible development of the invention the control member is, as already noted, arranged to be adjustable. This renders possible a simple fine adjustment of the timing of the venting action dependent on different marginal conditions, such as the quality of the paper and the like.

In accordance with a further advantageous development of the invention the closing member has a valve surface which is preferably pressed by a closing spring from the outside onto the associated seat. This serves to ensure that the closing member is held by the vacuum on the closing or valve surface when the suckers are under vacuum, this again tending to increase reliability of operation.

In accordance with a further development of the invention it is possible for the closing member to have a pivoting lever, which is provided with a valve plate and is adapted to cooperate with the closing spring, such lever running onto the control member. These features ensure that the closing member may be reliably transferred, against the closing forces acting against it, into the open position. Therefore there is a high degree of freedom from disorders.

In accordance with a further possible development of the invention it is possible for the venting opening to be provided at a central bearing member, which is provided with lateral arms, of the drag sucker support. Owing to this placement there is the advantage of a particularly large venting cross section. Furthermore this feature makes it possible to provide the venting opening generally in the center between two successive rows of drag suckers, that is to say generally in the middle between the actual drag suckers and the so-called auxiliary drag suckers, this meaning that all the drag suckers are equally well supplied with vacuum. Then in any event the arrangement is more advantageous than an arrangement with only one venting opening.

It is convenient if the pivoting lever of the closing member is designed as a third class lever which extends in the direction of the drag sucker support and which at its front end bears a follower element, which runs on a cam surface of the control member which is in the form of a skid. These features lead to a particularly straightforward structure and to reliable operation.

A further possible feature of the invention is such that in the case of there being a drag sucker support adapted to pivot about a vertical pivot axis, the venting opening is provided adjacent to this pivot axis. This ensures that the effect of the pivot angle of the drag sucker support on the timing of the venting is negligible.

In keeping with yet another possible form of the invention, which is particularly preferred, it is possible for the drag sucker support to have a plurality of, and more particularly two, venting openings provided adjacent to its lateral arms, with associated closing members. This design is more particularly suitable for upgrading existing sheet feeders. A further advantage is to be seen in the fact owing to there being a plurality of venting openings it is possible to achieve a particularly large overall venting cross section. Furthermore owing to the arrangement of the venting openings adjacent to the lateral arms, which are provided for receiving the suckers, there are particularly short vacuum connections and therefore a particularly small duct volume which is to be vented.

It is convenient if the control member in this case is simply in the form of a tappet which is able to be actuated by a closing member, which is respectively in the form of a first class lever. In the case of there being a pivoting arrangement of the drag sucker support in order to correct oblique positioning of the sheets, it is possible for the tappets to be simply arranged on a see-saw lever which is pivotally arranged on the suction head and whose pivot axis is arranged parallel to the pivot axis of the drag sucker support. This see-saw lever in this case constitutes a member which automatically assumes a position parallel to the drag sucker support so that all the venting openings are opened, even in the case of oblique sheet setting, simultaneously.

Further forms of the invention are described in the claims.

The invention will now be described in more detail with reference to the accompanying drawings, which show working embodiments thereof to make clear further advantages of the novel feeder design.

LIST OF THE SEVERAL VIEWS OF THE FIGURES

DETAILED ACCOUNT OF WORKING EMBODIMENTS OF THE INVENTION

Figure 1:
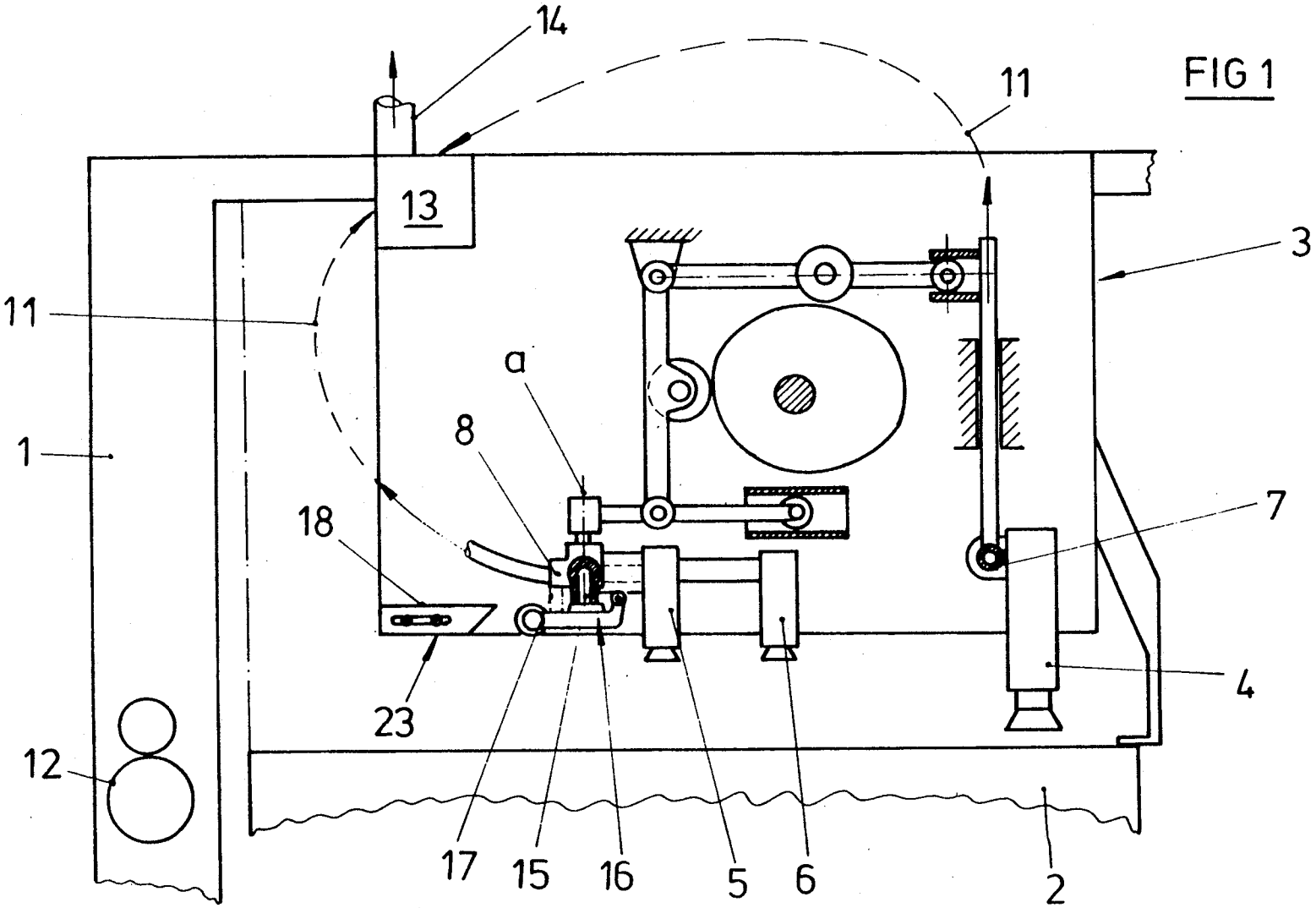
FIG. 1 is a longitudinal section taken through a sheet feeder in accordance with the invention as seen diagrammatically.

The sheet feeder as shown in FIG. 1 consists of a gantry-like frame 1 in which a stack table not illustrated in detail, is arranged so that it may be lifted and lowered. Above the stack 2 there is a suction head 3, which is provided with vertically movable separating suckers 4 and reciprocable drag suckers 5 and, respectively, auxiliary drag suckers 6. The separating suckers 4 which are arranged in the form of a row, are mounted on a vertically movable separating sucker support 7, which is provided with laterally projecting tubular arms. The drag suckers 5, which are also arranged in the form of a row, and the auxiliary suckers 6, are mounted on a reciprocable drag sucker support 8, which, as best shown in FIG. 2, is provided with arms 10, which laterally project from a center bearing member 9 and function to mount the respectively associated suckers.

The vertically moving suckers 4 and the drag suckers 5 and, respectively, the auxiliary suckers 6 are connected by means of the respectively associated support 7 and, respectively, 8 (which is respectively in the form of a section of a vacuum line) and by means of hoses 11, which are joined thereto and are marked in broken lines in FIG. 1, with a vacuum control valve 13, which is arranged on the suction head 3, such valve being connected by means of a vacuum main line 14 with a source of vacuum and serving to time the supply of vacuum to the suckers. With the aid of the separating suckers 4 the respectively uppermost sheet is lifted clear of the stack 2. This sheet is then received by the drag suckers 5 and the auxiliary suckers 6 and fed by the latter so far that it may be received and accepted by conveyor rolls 12 which are arranged adjacent to the intake edge of a conveyor belt table, such conveyor rolls 12 being operated intermittently as desired.

On the transfer of the sheet to the conveyor roll 12 it is released by the drag suckers 5 and, respectively, the auxiliary suckers 6. For this purpose the supply of vacuum to the said suckers is turned off and the suckers are internally vented. This venting action takes place in a very short time so that there is a sudden breaking of the vacuum. In order to accomplish this, adjacent to the vacuum line there is a venting device which is near to the suckers and has large venting cross sections, such venting device being actuated in the front terminal position of the drag sucker support 8 and thus in this manner independently of the speed of the machine so as to be solely dependent on the position of the reciprocating drag sucker support 8.

Figure 2:
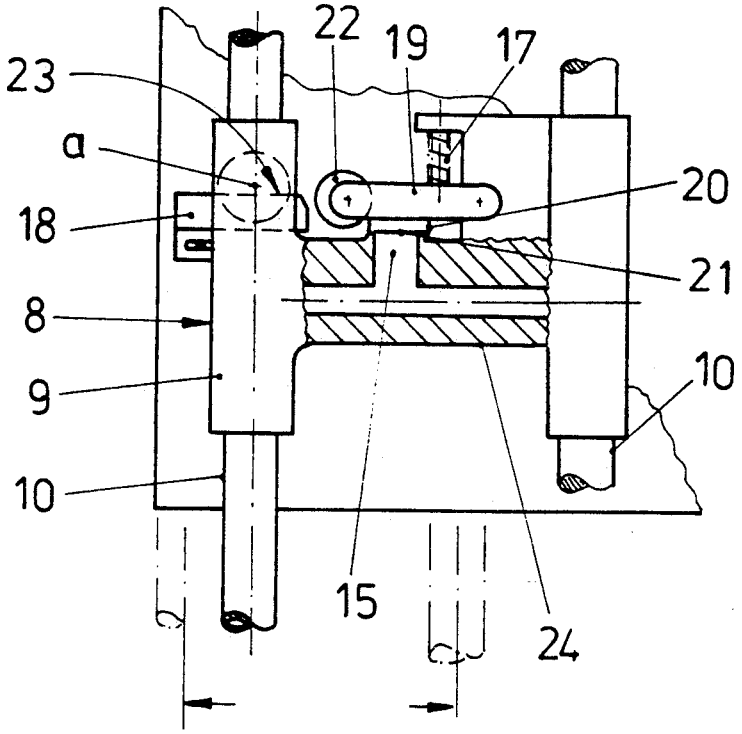
FIG. 2 is a view looking from below of a drag sucker support in accordance with the invention.

For this purpose it is possible, as shown in FIGS. 1 and 2, for the drag sucker support 8, which is included in the vacuum line, itself to be provided with a venting opening 15, which has a large cross section and is associated with a closing member 16, which is arranged on the drag sucker support 8, such closing member 16 normally being kept in the closed position by a closing spring 17 and which in the front terminal position of the drag sucker support 8 is moved by means of control member 18, which is secured stationarily to the suction head 3, into its open position, in which the venting opening 15, which has a large cross section, is accessible for venting the vacuum line.

In the illustrated working embodiment of FIGS. 1 and 2 a venting opening 15 is provided, which is positioned adjacent to the support member 9 of the drag sucker support 8. The closing member 16 associated with this venting opening 15 may, as best shown in FIG. 2, comprise a third class lever 19 which cooperates with the closing spring 17, is bearinged on the support member 9 and which is provided with a valve plate 20, which in the closed position rests on a closing surface 21 constituted by the end surface of a connection pipe having the venting opening 15 therein. At the front end, remote from the bearing, the pivoting lever 19 is provided with a follower element 22, here in the form of a follower roll. The control member 18 is in this case in the form of a follower skid which is provided with a cam surface 23 and on which the follower element 22 runs in the front terminal position of the drag sucker support 8 so that the lever 19 is rocked against the closing force acting on it and against the pressure differential and with it the valve plate 20 is moved clear of the closing surface 21. In this position the venting opening 15, which in relation to the lumen of the vacuum line has a comparatively large cross section, is opened so that when the connection with the vacuum source is turned off there is a rapid drop in the vacuum within the vacuum line running to the drag suckers 5 and, respectively, to the auxiliary drag suckers 6.

The skid constituting the follower member 18 is able to be set in the direction of movement of the drag sucker support 8 on the suction head 3 as is indicated by a slot connection. Owing to this fine setting of the timing of venting is possible. In order to ensure lower wear in operation the control or drive surface 23 is provided with a facet. However, in order to ensure rapid switching the facet has a steep slope.

In the illustrated working embodiment the drag sucker support 8 is adapted for pivoting movement about a generally vertical axis in order to correct so-called oblique setting of the sheets. In the case of pivoting movement of the drag sucker support 8 the latter also changes its alignment in relation to the control member 18 which is arranged stationarily on the suction head 3. In order to nevertheless avoid any influence resulting therefrom on the actuation of the venting device, in this case the venting opening 15 and accordingly also the closing member 16 associated with it, are arranged adjacent to the pivot axis a of the drag sucker support 8. In the illustrated working embodiment of FIG. 1 the connection pipe containing the venting opening 15, extends downwards from the drag sucker support 8 in order to make the drawing more straightforward. In such a case it is possible to center the venting opening 15 on the axis a. In fact, as best shown in FIG. 2, in practice the venting opening 15 is in the form of a lateral outlet. The latter may be positioned at a rib 24, which connects the limbs together (which are associated with the tubular arms 10), of the drag sucker support 9. The venting opening 15 is in this case on the side, which is nearer to the pivot axis 1 of the drag sucker support 8, of the rib 24 and therefore still so near to the axis a that in the case of oblique positioning of the drag sucker support 8 there is no substantial effect on the timing.

Figure 3:
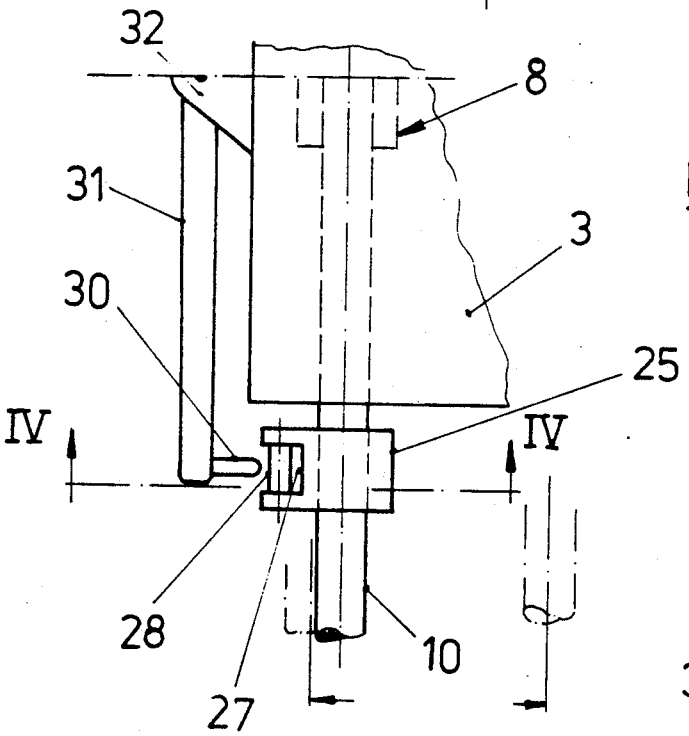
FIG. 3 shows a further embodiment of the invention presented in a manner similar to FIG. 2.
Figure 4:
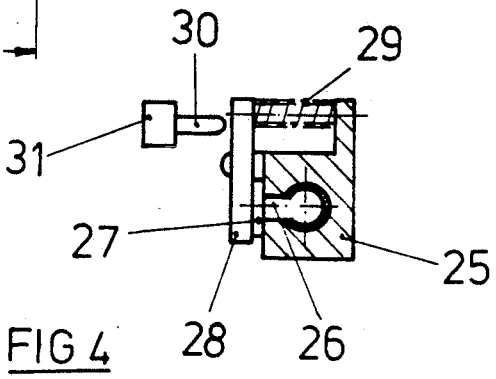
FIG. 4 shows a section taken on the line IV—IV of FIG. 3.

In the illustrated working embodiment of FIGS. 3 and 4 adjacent to the lateral arms 10 (which mount the suckers) of the drag sucker support 8 and preferably adjacent to the arms 10 associated with the actual drag suckers 5, there are two venting devices which are placed close to the respectively associated sucker, which is here not illustrated in detail. For this purpose the tubes constituting the arms 10 are provided with radial recesses, which are each covered over by a valve block 25, which is provided with a venting opening 26, as best shown in FIG. 4. The venting opening 26 is able to be closed by means of a valve plate 27, which is mounted on a first class lever 28 which extends transversely in relation to the direction of movement of the drag sucker support 8 and which is pivotally mounted intermediate its ends on the valve block 25 and whose arm remote from the plate is in cooperation with an associated closing spring 29. In order to move the pivoting levers 28 in the opening direction each pivoting lever is provided with a tappet 30 which is secured to the suction head 3 and in relation to which the drag sucker support 8 may be moved. The tappets 30 associated with the individual venting openings 26 may be separately secured to the suction head 3. In the illustrated working embodiment all the tappets 30, with which the valve blocks 25 (which are in alignment with each other) are associated, are received on a common see-saw lever 31, which is pivotally bearinged on the suction head 3, as indicated in FIG. 3 by the bearing support 32. With the aid of the see-saw lever 33 the tappets 30 are caused to follow the pivoting movement of the drag sucker support 8 if the latter is rocked about a vertical axis when the sheet is set obliquely, so that all venting openings 26 arranged on both sides of the pivot axis of the drag sucker support 8 are opened simultaneously. The initial resistance occurring when a cam 30 runs onto the associated pivot lever 39 and due to the closing spring associated with it, is in this case sufficient for the see-saw lever 31, whose pivot axis extends parallel to the pivot axis of the drag sucker support 8, to automatically assume a position parallel thereto.

In the above specification in conjunction with the engagement of the follower element on the associated drive or cam member and therefore the timing of the opening of the venting opening 15 there is a mention of the front terminal position of the drag suction support 8. This wording is used to mean the range of the front terminal position, which may begin even towards the end of the constant rate phase between the drag sucker support 8 and the conveyor means responsible for further movement of the products and which may extend as far as the front terminal position of the drag sucker support 8.

I claim:

1. A sheet feeder, comprising:

a suction head;

separating suckers;

a first support, which is capable of vertical movement, upon which said separating suckers are mounted, said first support being arranged on said suction head;

means for vertically moving said first support;

a second support arranged on said suction head, said second support, when in use, being reciprocated, said second support having at least one vent opening and a closing member associated with said vent opening;

means for reciprocating said second support;

vacuum means for supplying suction;

a control valve for said vacuum means for initiating and interrupting the supply of suction from said vacuum means;

conveyor means for transferring a sheet;

at least one row of drag suckers mounted on said second support, said second support comprising a part of a connection line from said vacuum means to said drag suckers, said drag suckers being supplied with suction by said vacuum means for transferring the sheet from said separating suckers to said conveyor means for further transport, the suction created by said vacuum means being interrupted by said control valve, upon completion of the transferring of the sheet to said conveyor means;

a control member mounted on said suction head and acting to lift said closing member of said second support for venting said drag suckers when the supply of suction is interrupted.

2. The sheet feeder according to claim 1, further wherein said second support is adapted for pivoting movement thereby righting oblique sheets.

3. The sheet feeder according to claim 2, wherein said second support pivots about a vertical axis and said vent opening is provided adjacent to the vertical pivot axis.

4. The sheet feeder according to claim 1, wherein said control valve is positioned on said suction head.

5. The sheet feeder according to claim 1, wherein the vent opening of said second support, together with the associated closing member, is arranged so that by means of said control member, the closing member is operated independent of an angular setting for said second support.

6. The sheet feeder according to claim 1, wherein the vent opening of said second support, together with said control member, is arranged so that by means of said control member, the closing member is operated independent of an angular setting for said second support.

7. The sheet feeder according to claim 1, wherein said control member is adjustably arranged on said suction head.

8. The sheet feeder according to claim 1, wherein said closing member includes a valve plate which is adapted to be pressed from an outer surface thereof onto an associated sealing surface.

9. The sheet feeder according to claim 8, wherein said closing member includes a pivot lever adapted for cooperation with a closing spring and having said valve plate, said pivot lever running onto said control member.

10. The sheet feeder according to claim 9, further comprising a follower element, wherein said pivot lever extends in a direction of movement of said second support and which, at its frontal end, bears said follower element.

11. The sheet feeder according to claim 10, wherein said control member is in the form a follower skid provided with a control surface onto which said follower element of said closing member runs.

12. The sheet feeder according to claim 10, wherein said follower element is in the form of a roll.

13. The sheet feeder according to claim 1, further comprising a central bearing member which is arranged adjacent to said vent opening of said second support, said central bearing member having lateral arms.

14. The sheet feeder according to claim 13, wherein said second support has a plurality of vent openings and associated closing members, said plurality of vent openings being provided adjacent to said lateral arms.

15. The sheet feeder according to claim 13, wherein said control member is in the form of a tappet.

16. The sheet feeder according to claim 15, wherein said vent openings and said associated closing members are arranged so that by means of said control member, the closing members is operated independently of a pivot setting of said second support and said tappet is arranged on a see-saw lever bearinged on said suction head with a pivot axis of said see-saw lever arranged to be parallel to the axis of said second support.

17. The sheet feeder according to claim 15, wherein said vent opening and said control member are arranged so that by means of said control member, the closing member is operated independently of a pivot setting of said second support and said tappet is arranged on a see-saw lever bearinged on said suction head with a pivot axis of said see-saw lever arranged to be parallel to the axis of said second support.

18. The sheet feeder according to claim 1, wherein said second support has a plurality of vent openings and associated closing members.

19. The sheet feeder according to claim 1, further comprising arms which bear said drag suckers.

20. The sheet feeder according to claim 1, wherein said vent opening is provided adjacent said drag suckers.

21. The sheet feeder according to claim 1, wherein said closing member is in the form of a lever extending transversely in relation to the direction of movement of the second support, said lever having an arm which are in cooperation of an associated closing spring.

22. The sheet feeder according to claim 1, further comprising auxiliary drag suckers, said second support further including a bearing member having parallel arms supporting said drag suckers and said auxiliary drag suckers, said bearing member having a rib with a vent opening, said rib being positioned between said arms.

23. The sheet feeder according to claim 22, wherein the vent opening of said rib is a lateral outlet which is adjacent to the pivot axis of said second support.

* * * * *